US005179245A

United States Patent [19]

Straka

[11] Patent Number: 5,179,245

[45] Date of Patent: Jan. 12, 1993

[54] SEMI-AUTOMATIC RIFLE ADAPTER APPARATUS

[76] Inventor: Benedict J. Straka, 44 Water St., Jenners, Pa. 15546

[21] Appl. No.: 806,474

[22] Filed: Dec. 13, 1991

[51] Int. Cl.[5] ..... F41C 23/16

[52] U.S. Cl. ..... 89/1.4; 89/1.42; 42/71.01; 42/90

[58] Field of Search ..... 42/71.01, 71.02, 72, 42/90; 89/1.42, 1.4, 30

[56] References Cited

U.S. PATENT DOCUMENTS

| | | | |
|---|---|---|---|
| 173,339 | 2/1876 | Pruyn | 89/30 |
| 2,832,165 | 4/1958 | Ivy | 42/71.01 |
| 4,759,145 | 7/1988 | Volansky | 42/71.01 |
| 4,926,739 | 5/1990 | Byron | 89/1.4 |

FOREIGN PATENT DOCUMENTS

| | | | |
|---|---|---|---|
| 702759 | 2/1941 | Fed. Rep. of Germany | 89/1.42 |
| 888965 | 12/1943 | France | 89/1.42 |

*Primary Examiner*—Stephen M. Johnson
*Attorney, Agent, or Firm*—Leon Gilden

[57] ABSTRACT

An adapter arranged to permit conversion of a semi-automatic rifle into a manual bolt action rifle is provided wherein a gas port blocking assembly is mounted to the barrel of the rifle, with a first bore in the blocking assembly receiving the barrel therethrough, with a second bore receiving in a slidable relationship an actuator rod therethrough, with an actuator rod handle permitting reciprocation of the actuator rod relative to the rifle, wherein a rear distal end of the actuator rod is fixedly mounted to the rifle bolt handle effecting cocking and loading of the rifle upon reciprocation of the actuator rod.

2 Claims, 4 Drawing Sheets

SEMI-AUTOMATIC RIFLE ADAPTER APPARATUS

BACKGROUND OF THE INVENTION

1. Field of the Invention

The field of invention relates to rifle apparatus, and more particularly pertains to a new and improved semi-automatic rifle adapter apparatus wherein the same permits conversion of a semi-automatic rifle to a full manual operation.

2. Description of the Prior Art

Various accessories for rifles and the like are available in the prior art. Semi-automatic rifles for example are prohibited by statute in many geographical areas for hunting and accordingly, conversion of such a rifle to a pump-type action permits utilization of such a rifle in a hunting situation. Further, conversion to a manual configuration further provides for increased marksmanship and ability to use the rifle by individuals in a training procedure.

Prior art rifle accessories are available in the prior art and are exemplified in U.S. Pat. No. 4,934,084 to Thomas setting forth a reinforced rifle stock.

U.S. Pat. No. 3,623,257 to Ray sets forth a further example of a rifle grip member.

U.S. Pat. No. 4,856,217 to Benelli sets forth a cartridge feeding assembly for use with semi-automatic or pump actuating rifles and shotguns.

As such, it may be appreciated that there continues to be a need for a new and improved semi-automatic rifle adapter apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of rifle apparatus now present in the prior art, the present invention provides a semi-automatic rifle adapter apparatus wherein the same is arranged for conversion of a semi-automatic rifle to manual actuation. As such, the general purpose of the present invention, which will be described subsequently in greater detail, is to provide a new and improved semi-automatic rifle adapter apparatus which has all the advantages of the prior art rifle apparatus and none of the disadvantages.

To attain this, the present invention provides an adapter arranged to permit conversion of a semi-automatic rifle into a manual bolt action rifle, wherein a gas port blocking assembly is mounted to the barrel of the rifle, with a first bore in the blocking assembly receiving the barrel therethrough, with a second bore receiving in a slidable relationship an actuator rod therethrough, with an actuator rod handle permitting reciprocation of the actuator rod relative to the rifle, wherein a rear distal end of the actuator rod is fixedly mounted to the rifle bolt handle effecting cocking and loading of the rifle upon reciprocation of the actuator rod.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved semi-automatic rifle adapter apparatus which has all the advantages of the prior art rifle apparatus and none of the disadvantages.

It is another object of the present invention to provide a new and improved semi-automatic rifle adapter apparatus which may be easily and efficiently manufactured and marketed.

It is a further object of the present invention to provide a new and improved semi-automatic rifle adapter apparatus which is of a durable and reliable construction.

An even further object of the present invention is to provide a new and improved semi-automatic rifle adapter apparatus which is susceptible of a low cost of manufacture with regard to both materials and labor, and which accordingly is then susceptible of low prices of sale to the consuming public, thereby making such semi-automatic rifle adapter apparatus economically available to the buying public.

Still yet another object of the present invention is to provide a new and improved semi-automatic rifle adapter apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
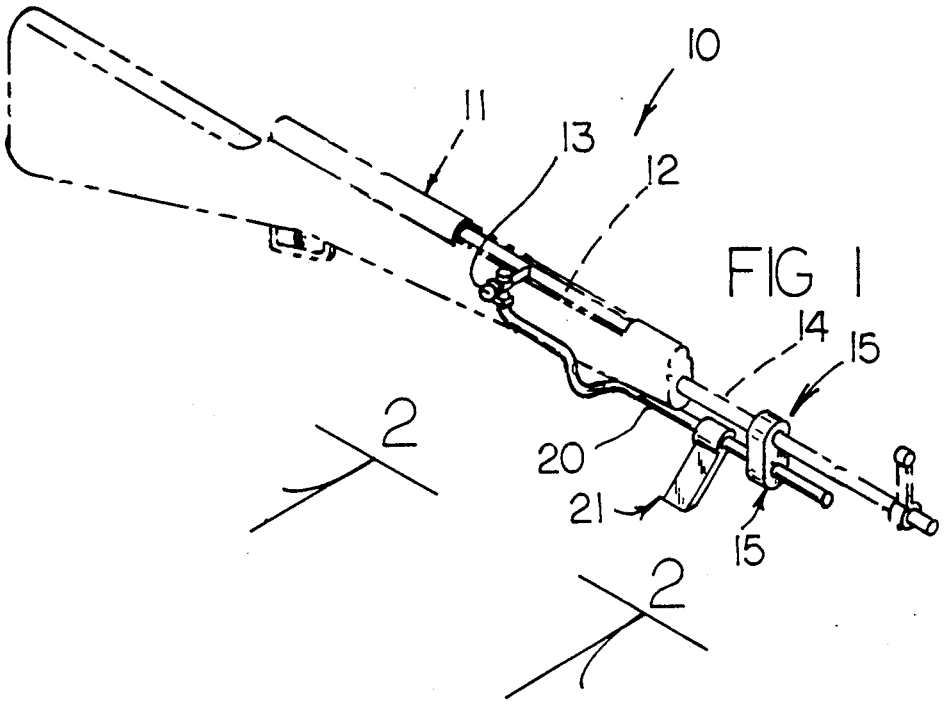
FIG. 1 is an isometric illustration of the instant invention mounted to an associated rifle.
Figure 2:
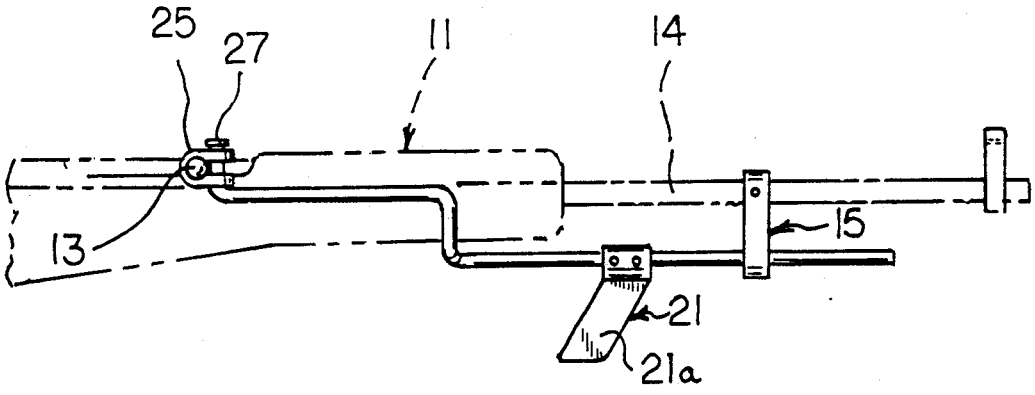
FIG. 2 is an orthographic view, taken along the lines 2—2 of FIG. 1 in the direction indicated by the arrows.
Figure 3:
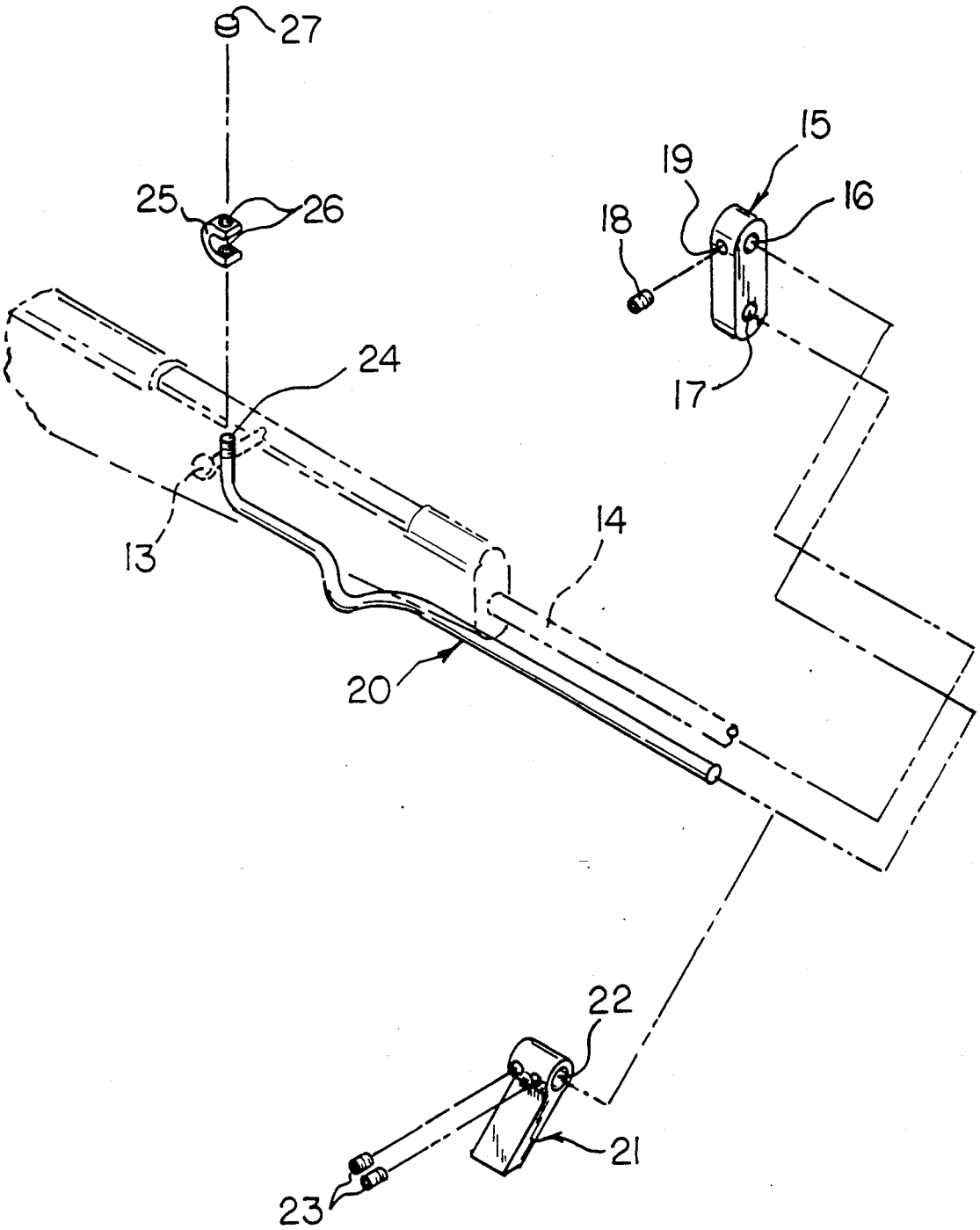
FIG. 3 is an isometric illustration of the invention in an exploded configuration.

With reference now to the drawings, and in particular to FIGS. 1 to 8 thereof, a new and improved semi-automatic rifle adapter apparatus embodying the principles and concepts of the present invention and generally designated by the reference numeral 10 will be described.

More specifically, the semi-automatic rifle adapter apparatus 10 of the instant invention essentially comprises a combination of the rifle assembly 11, including a rifle bolt 12 formed with a bolt handle 13 projecting at an oblique angle relative to the rifle bolt. A rifle barrel 14 aligned with the rifle bolt includes a gas port as is conventional with such semi-automatic weapons as the "AK-47" or SKS type 56.

Initially, in use of the organization, removal of a gas piston associated with the semi-automatic actuation of the associated rifle is effected along with the associated gas piston tube and upper forearm to effect and permit the driving out of a retaining pin relative to an associated gas diverter (not shown) of conventional knowledge relative to such rifles. The gas port is directed through the associated rifle 14, with a gas port blocking assembly 15 provided by the invention. The gas port blocking assembly 15 includes a first bore 16 parallel to a second bore 17. The first bore 16 receives the rifle barrel 14 therethrough and is positioned above and overlying the associated gas port, as noted above. The blocking assembly 15 includes a lock fastener 18 received within the lock fastener bore 19 intersecting the first bore 16 to fixedly secure the assembly 15 relative to the rifle barrel 14. An actuator rod 20 is slidably received through the second bore 17, with an actuator rod handle 21 mounted to the actuator rod 20. A handle body 21*a* projects below an associated handle bore 22 receiving the actuator rod 20 therethrough. Handle fasteners 23 directed into the handle 21 intersect the handle bore 22 to secure the actuator rod 20 in an adjustable manner relative to the actuator rod 20. An actuator rod rear distal end 24 is oriented relative to the rifle bolt 12, wherein a "C" bracket 25 receives the rifle bolt handle 13 between spaced legs of the "C" bracket, wherein the "C" bracket includes coaxially aligned "C" bracket bores 26 receiving the actuator rod rear distal end 24 therethrough, wherein an actuator rod lock fastener 27 mounted to the rear distal end 24 when directed through the "C" bracket 25 for securement of the actuator rod 20 relative to the associated rifle bolt handle 13. In this manner, reciprocation of the actuator rod handle 21 effects reciprocation of the associated bolt 12 for operation of the associated rifle in a manual operation.

Figure 4:
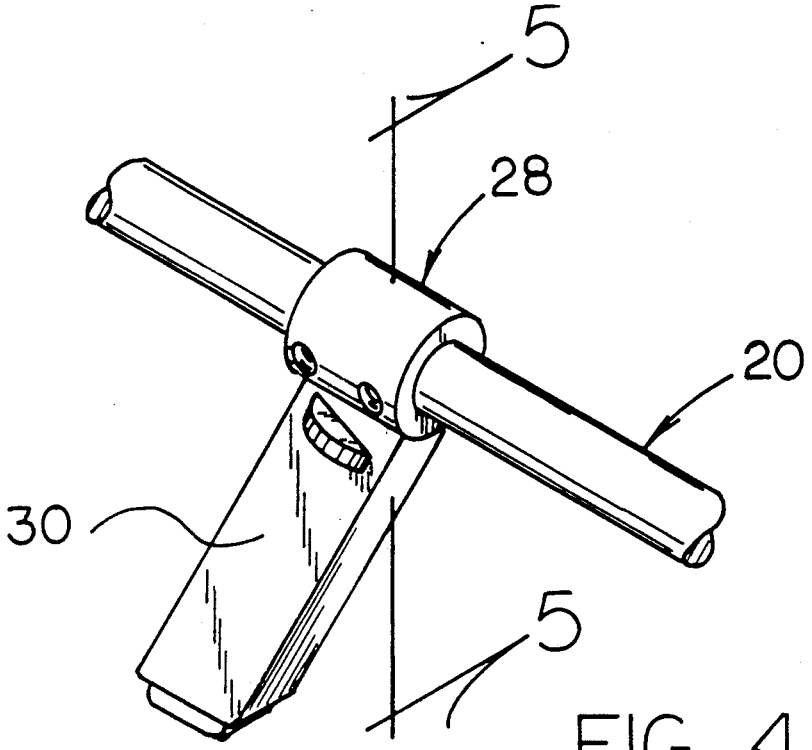
FIG. 4 is an enlarged isometric illustration of a modified handle structure utilized by the invention.
Figure 5:
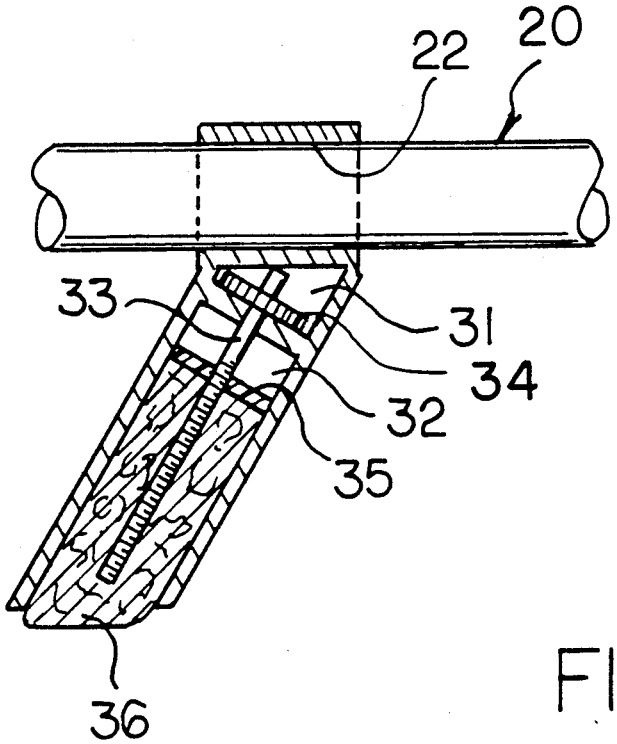
FIG. 5 is an orthographic view, taken along the lines 5—5 of FIG. 4 in the direction indicated by the arrows.

A modified handle 28 is illustrated in the FIGS. 4 and 5, wherein a handle body 30 projects downwardly relative to the handle bore 22, in a manner as described above. A handle body first cavity 31 positioned adjacent the handle bore 22 is positioned above a handle body second cavity 32. The first cavity 31 and the second cavity 32 are divided by a handle web with a rod 33 coaxially directed through the handle body second cavity 32, with its upper distal end positioned within the first cavity 31 and a rod disc 34 fixedly mounted to the rod 33 within the first cavity 31, with the rod disc 34 projecting exteriorly of the handle body 30. Upon rotation of the rod disc 34, the externally threaded rod 33 is rotated, whereupon an internally threaded piston plate 35 is thereby displaced relative to the handle web. A camouflage paint compound 36 is positioned within the second cavity 32 and is projected exteriorly through a lower distal end of the handle body 30 upon projection of the piston plate 35 downwardly along the rod 33 for use by an individual.

Figure 6:
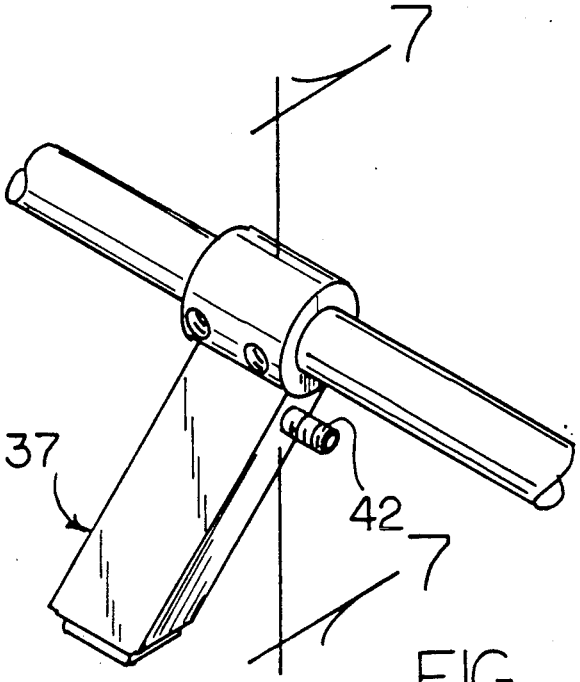
FIG. 6 is an isometric illustration of a further modification of the handle structure of the invention.
Figure 7:
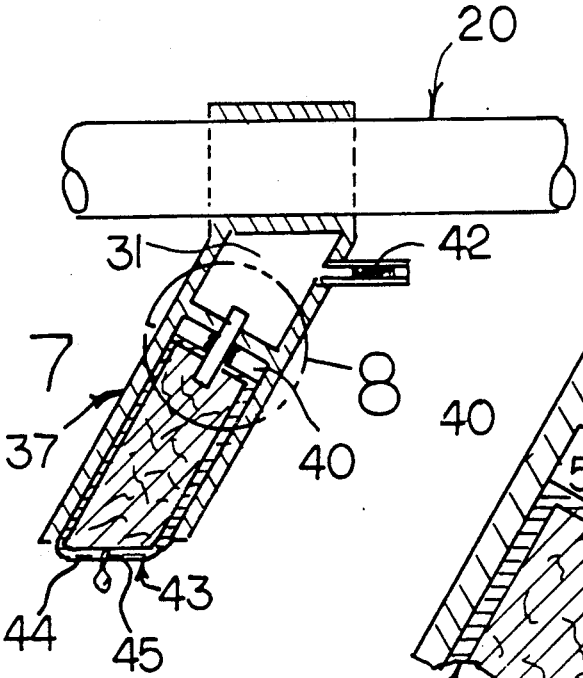
FIG. 7 is an orthographic view, taken along the lines 7—7 of FIG. 6 in the direction indicated by the arrows.
Figure 8:
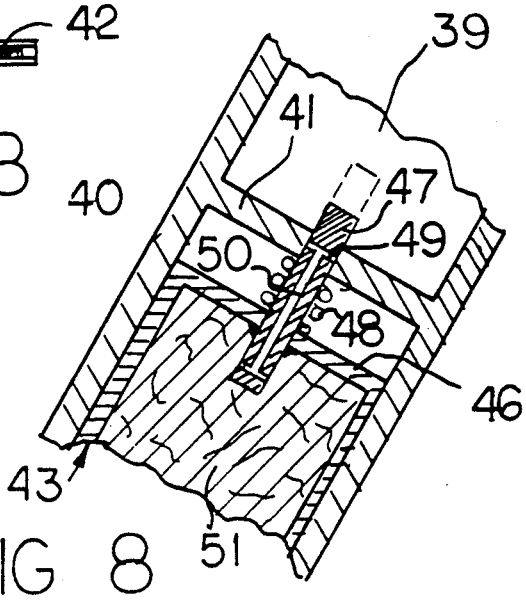
FIG. 8 is an enlarged orthographic view of section 8, as set forth in FIG. 7.

A further modified handle 37 is illustrated in the FIGS. 6–8 to include a gas chamber 39 positioned adjacent the handle bore 22, with a handle chamber 40 extending from the gas chamber 39 downwardly through a lower distal end or floor portion of the handle 37. An inner face web 41 divides the gas chamber 39 relative to the handle chamber 40. A gas fill valve 42 effects pressurizing of the gas chamber 39. A canister insert 43 is mounted within the handle chamber 40, with a canister insert floor 44 including a floor port 45 directed therethrough to permit projection of an associated camouflage type viscous fluid from the canister insert 43, and more specifically through the floor port 45. A canister valve 47 is mounted within the canister insert top wall 46, with the canister valve 47 fixedly mounted to the top wall 46 and slidably directed through the inner face web 41. A spring 48 captured between the inner face web 41 and the top wall 46 normally biases the canister insert 43 downwardly. A first canister valve port 49 normally biased and positioned within the inner face hook 41 may be projected upwardly upon manual displacement of the canister insert 43 upwardly by manually providing a force upon the canister floor 44 upwardly into the handle chamber 40. In this manner, the first canister valve ports 49 are thereby exposed directing pressurized gas from the gas chamber 39 into the canister valve ports 49 and thereafter into the second canister valve ports 50 pressurizing the canister insert 43 therewithin projecting the viscous fluid 51 through the floor port 45 for use by an individual.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rifle adapter apparatus in combination with a rifle assembly including a rifle bolt, with the rifle bolt including a rifle bolt handle obliquely mounted to the rifle bolt, and the rifle assembly including a rifle barrel extending forwardly of the rifle bolt, and wherein the apparatus comprises, a gas port blocking assembly secured to the rifle barrel, the gas port blocking assembly including an assembly first bore spaced from and parallel a second bore, the first bore receiving the rifle barrel therethrough, and a lock fastener bore intersecting the first bore, and a lock fastener directed through the lock fastener bore for securement of the rifle barrel within the assembly first bore, and an actuator rod, with the actuator rod slidably directed through the second bore adjacent a forward distal end of the actuator rod, and an actuator rod handle mounted to the actuator rod, the actuator rod handle including an actuator rod bore receiving the actuator rod therethrough, and an actuator rod handle body projecting downwardly below the handle bore, and at least one fastener directed into the actuator rod handle intersecting the actuator rod handle bore and the actuator rod for securement of the actuator rod within the actuator rod handle bore, and the actuator rod including a rear distal end, the rear distal end projecting upwardly relative to the handle and directed through the "C" shaped bracket, the "C" shaped bracket receiving the rifle bolt handle therethrough, with the "C" shaped bracket including a plurality of coaxially aligned "C" shaped bracket bores, with the rear distal end directed through the "C" shaped bracket bores, and fastener means for securement of the actuator rod rear distal end within the "C" shaped bracket bores.

2. An apparatus as set forth in claim 1 wherein the actuator rod handle includes a first chamber positioned within the handle body adjacent the handle bore, and a second chamber adjacent said first chamber, and an inner face web positioned between the first chamber and the second chamber, and a gas fill valve directed through the handle body into the first chamber to permit selective pneumatic pressurizing of the first chamber, and a canister insert slidably mounted within the second chamber, the canister insert including a canister insert floor and a canister insert top wall, a canister insert floor port is directed through the canister insert floor into the canister insert, with the canister insert including a viscous fluid contained therewithin, and a canister valve fixedly mounted within the canister insert top wall orthogonally oriented relative to the canister insert top wall and with the valve slidably received within the inner face web, and the canister valve including a spring captured between the inner face web and the canister insert top wall, and at least one first canister valve port within the canister valve positioned within the inner face web in a first position and displaced from the inner face web in a second position projecting into the first chamber, and a second canister valve port intersecting the first canister valve port, with the second canister valve port in pneumatic communication with the second chamber, where displacement of the canister insert from the first position to said second position effects displacement of the viscous fluid through the canister insert floor port.

* * * * *